US009879931B2

(12) United States Patent
Patel

(10) Patent No.: US 9,879,931 B2
(45) Date of Patent: Jan. 30, 2018

(54) MODULAR MULTI-CALIBER BELT-FED MACHINE GUNS

(71) Applicant: Swetal K. Patel, Dallas, GA (US)

(72) Inventor: Swetal K. Patel, Dallas, GA (US)

( * ) Notice: Subject to any disclaimer, the term of this patent is extended or adjusted under 35 U.S.C. 154(b) by 24 days.

(21) Appl. No.: 15/132,778

(22) Filed: Apr. 19, 2016

(65) Prior Publication Data

US 2016/0305725 A1 Oct. 20, 2016

Related U.S. Application Data

(60) Provisional application No. 62/150,008, filed on Apr. 20, 2015.

(51) Int. Cl.

| | |
|---|---|
| ***F41A 9/37*** | (2006.01) |
| ***F41A 11/02*** | (2006.01) |
| ***F41A 9/29*** | (2006.01) |

(52) U.S. Cl.

CPC ..... *F41A 9/37* (2013.01); *F41A 9/29* (2013.01); *F41A 11/02* (2013.01)

(58) Field of Classification Search

CPC ..... F41A 9/29; F41A 9/37; F41A 11/02
See application file for complete search history.

(56) References Cited

U.S. PATENT DOCUMENTS

| | | | | |
|---|---|---|---|---|
| 3,386,336 | A * | 6/1968 | Roy | F41A 3/72 42/75.02 |
| 4,066,000 | A * | 1/1978 | Rostocil | F41A 9/30 42/25 |
| 4,128,040 | A * | 12/1978 | Schuetz | F41A 21/26 89/14.5 |
| 7,644,528 | B2 * | 1/2010 | Wossner | F41A 21/48 42/75.02 |
| 2003/0177896 | A1 * | 9/2003 | Dionne | F41A 9/54 89/33.2 |
| 2010/0229445 | A1 * | 9/2010 | Patel | F41A 3/66 42/6 |
| 2015/0323268 | A1 * | 11/2015 | Kokinis | F41A 11/02 89/193 |

* cited by examiner

*Primary Examiner* — Gabriel Klein
(74) *Attorney, Agent, or Firm* — Thomas | Horstemeyer, LLP

(57) ABSTRACT

Various embodiments of multi-caliber machine gun systems are described. A multi-caliber machine gun system can include a receiver assembly, a first ammunition feed tray, and a second ammunition feed tray. The first ammunition feed tray can be configured to removably attach to the receiver assembly and to feed a first type of ammunition to the receiver assembly. The second ammunition feed tray can be configured to removably attach to the receiver assembly and to feed a second type of ammunition to the receiver assembly. The receiver assembly can be configured to fire the first type of ammunition when the first ammunition feed tray is removably attached to the receiver assembly. The receiver assembly can be configured to fire the second type of ammunition when the second ammunition feed tray is removably attached to the receiver assembly.

22 Claims, 6 Drawing Sheets

MODULAR MULTI-CALIBER BELT-FED MACHINE GUNS

CROSS REFERENCE TO RELATED APPLICATIONS

The present application is non-provisional of, and claims priority to, U.S. Provisional Application No. 62/150,008, filed on Apr. 20, 2015 and titled "MODULAR MULTI-CALIBER BELT-FED MACHINE GUN," the entirety of which is incorporated by reference.

FIELD OF THE INVENTION

The present invention relates to modular belt-fed machine guns.

BACKGROUND

The belt-fed machine gun is a type of weapon system commonly used by military forces. Common types of machine guns currently used by U.S. and NATO forces include the M240 and M2HB. Typically, most conventional machine guns have been designed and manufactured for specific tasks and combat applications, with the result being that the guns are limited to use with only specific calibers and/or types of ammunition. For example, the M240 machine gun is ordinarily manufactured for use with 7.62 mm ammunition, while the M2HB machine gun is ordinarily manufactured for use with .50bmg caliber ammunition.

Due to increasing demands on the capabilities of combat units and constantly evolving threats, there is increasing need for a machine gun that can be modified to fire different types of ammunition and to be easily reconfigured for use with different caliber rounds.

Contemporaneously, combat forces have recognized limitations between firearms that fire the 7.62 mm round and firearms that fire the .50bmg caliber round, particularly among U.S. and NATO forces currently engaged in combat operations in Afghanistan and elsewhere. These limitations, for example, in the sniper rifle type firearms, consisted of the relatively heavier weight of the .50bmg rifle round and the relative shorter range and target impact of the 7.62 mm rifle round. One solution to these contrasting features was the implementation of a sniper rifle using the .338 Lapua Magnum caliber round, which was introduced for sniper rifles to provide long-range capability and accuracy in a sniper rifle beyond the effective range of the .50bmg caliber round—usually 1,000 to 2,000 yards—while weighing half of the weight of a .50bmg caliber round.

This same dilemma is present in existing belt-fed machine guns. The M240 machine gun, designed to fire 7.62 mm rounds, can weigh approximately 27 pounds. The M2HB machine gun, designed to fire .50bmg caliber rounds, can weigh over 100 pounds, requiring it to be a mounted and crew-served weapon system. At present, there is no machine gun that can fire the .338 Lapua Magnum caliber round using disintegrating links, such as are used in the M240 machine gun, and no man-portable machine gun with the long-distance range and target impact of the M2HB.

Moreover, there is, at present, no such machine gun that offers the ability to interchangeably fire the 7.62 mm round and the .338 Lapua Magnum caliber round. Typical issue ammunition for combat infantry soldiers includes linked 7.62 mm rounds for use in M240 and MK48 machine guns, which rounds are carried both by individual soldiers as well as in transport vehicles such as the HMMV and Armored Personnel Carrier. .338 Lapua Magnum ammunition is not typically issued to normal combat infantry soldiers. Thus, if a soldier equipped with a .338 Lapua Magnum caliber weapon were to run out of ammunition, the soldier could not employ the relatively abundant supply of 7.62 mm rounds to use in the weapon manufactured for firing only .338 Lapua Magnum caliber ammunition.

Finally, there is, at present, no multi-caliber, modular machine gun that integrates a quick takedown system whereby rapid reconfiguration from firing .338 Lapua Magnum caliber ammunition to firing 7.62 mm ammunition is possible in combat conditions and with no tools. A multi-caliber machine gun must be quickly and easily configurable as needed to fit the soldier's particular needs or for use in a particular combat situation.

It therefore can be seen that a heretofore unmet need exists for a modular multi-caliber belt-fed machine gun that addresses the foregoing and other related and unrelated problems in the art.

SUMMARY OF THE INVENTION

In embodiments, this new modular multi-caliber belt-fed machine gun system and method can provide combat soldiers with a man-portable machine gun that can engage targets out to approximately 1,500 yards by firing linked .338 Lapua Magnum caliber rounds. The machine gun system can weigh less than 30 pounds but still have the long-range capability of the .50bmg caliber machine gun but with higher accuracy.

In embodiments, this new modular multi-caliber belt-fed machine gun system can provide combat soldiers with a man-portable machine gun that can engage targets out to approximately 1,500 yards by firing linked .338 Lapua Magnum caliber rounds and can quickly and easily be reconfigured in the field to fire linked 7.62 mm rounds for shorter-range applications and/or to take advantage of the more abundant supply of 7.62 mm linked ammunition in forward-deployed combat units.

In embodiments, this new modular multi-caliber belt-fed machine gun system can provide combat soldiers with a man-portable machine gun that can interchangeably fire .338 Lapua Magnum caliber and 7.62 mm rounds, where the interchangeability can be achieved quickly and easily in the field by way of an integrated quick-takedown capability, with no tools needed.

A modular multi-caliber machine gun that can fire a .338 Lapua Magnum caliber long-range round as well as the current-issue 7.62 mm round can make for a weapon system ideally suited for overwatch positions and long-range targets, such as those frequently encountered in mountainous terrain and in the flatter terrain of urban-area roadways, where it is desirable to engage targets beyond the range of 7.62 mm rounds.

It should be emphasized that the above-described embodiments of the present invention, particularly, any "preferred" embodiments, are merely possible examples of implementations, merely set forth for a clear understanding of the principles of the invention. Other systems, devices, methods, features, and advantages of the disclosed system and method include variations and modifications apparent or that may become apparent to one of skill in the art upon examination of the following figures and detailed description, without departing substantially from the spirit and principles of the invention. All such modifications and variations are intended to be included within this description and are intended to be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Disclosed below are embodiments of modular multi-caliber belt-fed machine gun systems and methods for firing multiple types of rounds from the same receiver body using interchangeable top cover assemblies and ammunition feed trays. The discussion below describes multi-caliber belt-fed machine gun systems that can fire both .338 Lapua Magnum caliber rounds and 7.62 mm rounds from the same receiver. Alternative modular multi-caliber belt-fed machine gun systems within the scope of the present disclosure can fire other types of rounds. For example, some embodiments can fire both .338 Lapua Magnum caliber rounds and 5.56 NATO rounds from the same receiver. Additionally, other embodiments can fire both 5.56 NATO rounds and 7.62 mm rounds from the same receiver. It should be understood that modular multi-caliber belt-fed machine guns systems that can fire other types of rounds are within the scope of the present disclosure.

Figure 1:
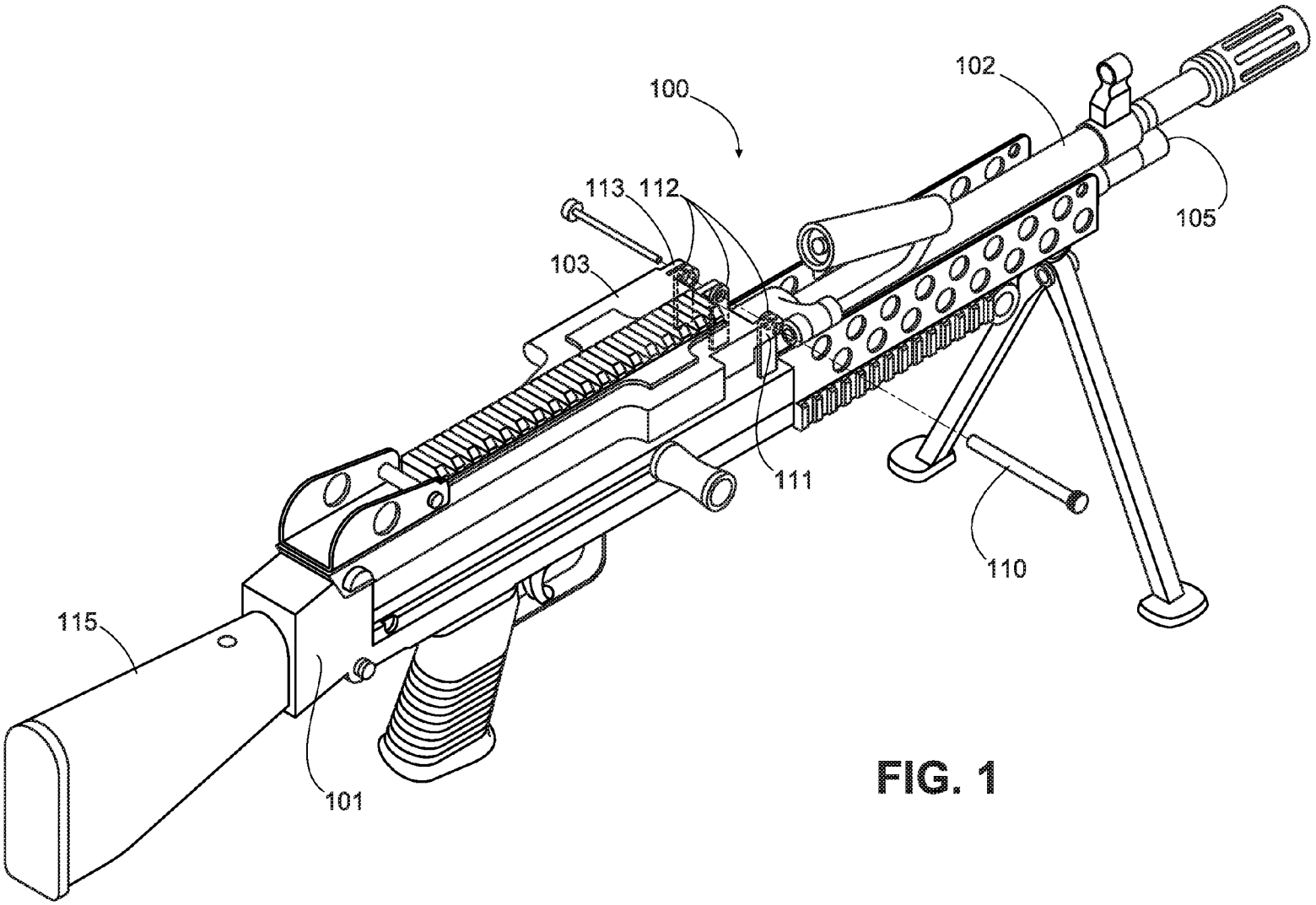
FIG. 1 is a perspective view of components of a modular multi-caliber belt-fed machine gun system in accordance with an exemplary embodiment of the present invention, where the configuration depicted is for firing a .338 Lapua Magnum caliber round.

FIG. 1 is a perspective view of components of a modular multi-caliber belt-fed machine gun system 100 in accordance with an embodiment of the present disclosure. The gun system 100 can comprise a two-piece receiver assembly 101, a .338 Lapua Magnum caliber barrel assembly 102, a .338 Lapua Magnum top cover assembly 103, a .338 Lapua Magnum bolt carrier assembly (not visible in FIG. 1), and an operating rod assembly 105. When the .338 Lapua Magnum caliber barrel assembly 102, top cover assembly 103, and bolt carrier assembly are installed as shown in FIG. 1, the gun system 100 is configured to fire .338 Lapua Magnum caliber ammunition.

Although not shown in FIG. 1, the gun system 100 can also comprise a 7.62 mm round barrel assembly, a 7.62 mm round top cover assembly, and a 7.62 mm round bolt carrier assembly. When the .338 Lapua Magnum caliber barrel assembly 102, top cover assembly 103, and bolt carrier assembly are removed and replaced with the 7.62 mm round barrel assembly, top cover assembly, and bolt carrier assembly, as will be described later in further detail, the gun system 100 can be configured to fire 7.62 mm rounds.

The gun system 100 can also include a stock 115. According to various embodiments, the stock 115 can be fixed, foldable, telescopic, or collapsible.

In embodiments, the receiver assembly 101 can comprise machined or formed sheet metal. The .338 Lapua Magnum caliber top cover assembly 103 can be secured to the receiver assembly 101 by a removable hinge block pin 110. The hinge block pin 110, when inserted into a first hinge block pin receptacle 111, the .338 Lapua Magnum caliber top cover assembly pin receptacles 112, and the second hinge block pin receptacle 113, can retain the front portion of the .338 Lapua Magnum caliber top cover assembly 103 in place when the gun system 100 is fired. The hinge block pin 110 can be removed to release the .338 Lapua Magnum caliber top cover assembly 103 from the receiver assembly 101 for changing the firing caliber of the gun system 100.

Figure 2:
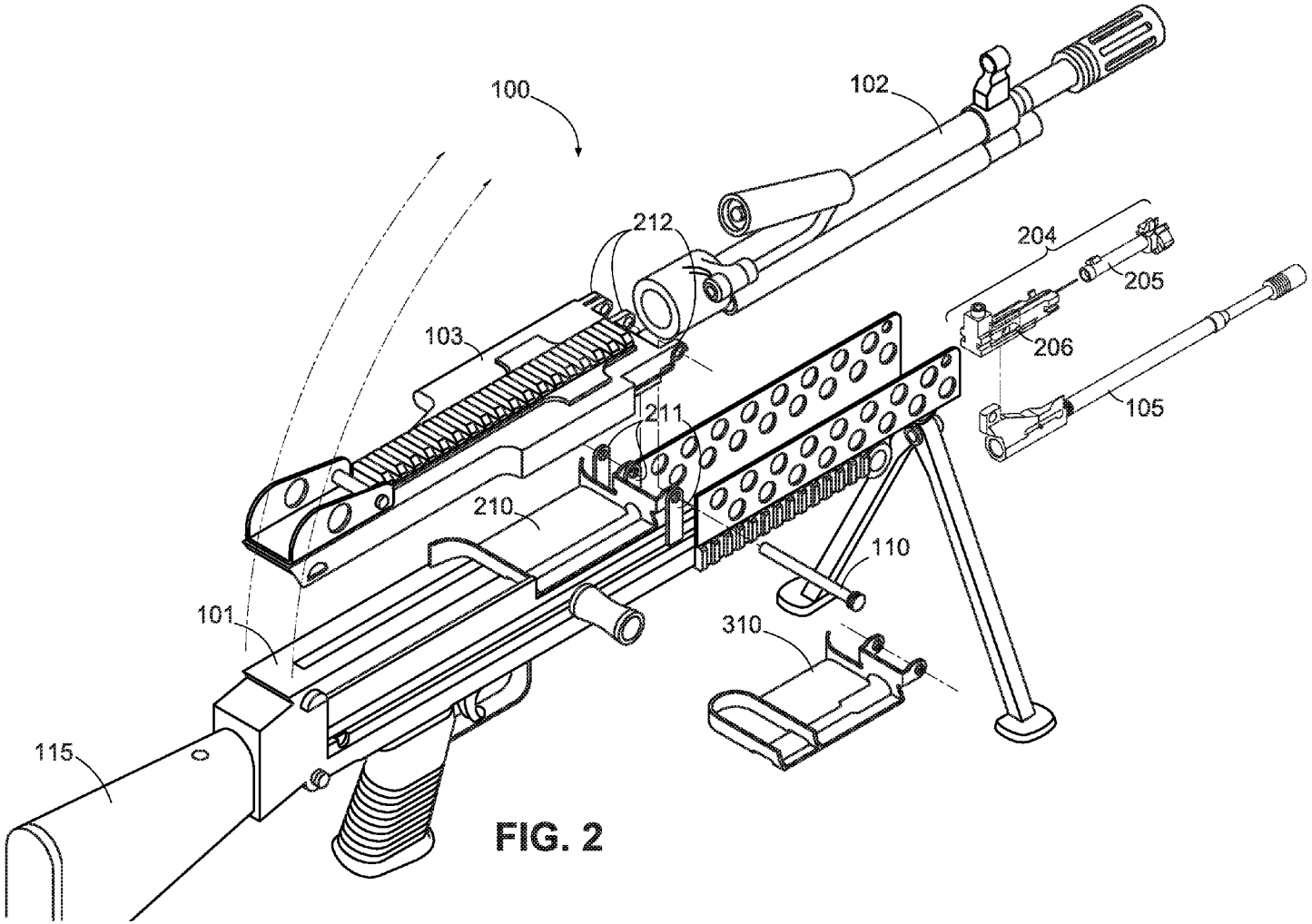
FIG. 2 is a perspective view of components of the modular multi-caliber belt-fed machine gun system of FIG. 1, showing an exploded view of the components of the bolt carrier assembly.

FIG. 2 is a perspective view of the modular multi-caliber belt-fed machine gun system 100 of FIG. 1, showing embodiments of interchangeable components that can facilitate the gun system 100 firing either 7.62 mm rounds or .338 Lapua Magnum caliber rounds. As will be described in further detail, the gun system 100 can fire either 7.62 mm rounds or .338 Lapua Magnum caliber rounds by use of separate feed trays and top covers configured for each corresponding type of ammunition. The configuration depicted in FIG. 2 is for firing the .338 Lapua Magnum caliber round.

In embodiments, a .338 Lapua Magnum caliber feed tray 210 can be removably attached to the receiver assembly 101 by the hinge block pin 110 being removably inserted first into the first hinge block pin receptacle 111, the top cover assembly pin receptacles 112 when the .338 Lapua Magnum caliber top cover assembly 103 is fitted onto the top of receiver assembly 101 over the feed tray 210, through feed tray pin receptacles 211, and through the second hinge block pin receptacle 113. The .338 Lapua Magnum caliber top cover 103 and feed tray 210 allow .338 Lapua Magnum caliber linked rounds to be fed into the receiver assembly 101 for firing through the .338 Lapua Magnum caliber barrel assembly 102 by the bolt carrier assembly 204 and operating rod assembly 105 comprising a gas cylinder piston.

FIG. 2 shows an exploded view of the components of the .338 Lapua Magnum caliber bolt carrier assembly 204. In embodiments, the .338 Lapua Magnum caliber bolt carrier assembly 204 can comprise a bolt 205 with a bolt face designed to fit a .338 Lapua Magnum caliber round and a carrier 206, each removably attached, contained within receiver assembly 101, and removably attached to operating rod assembly 105 with a bolt retaining pin.

In embodiments, the .338 caliber barrel assembly 102 can be removably attached to the receiver assembly 101 by a spring-loaded pin and lever, which can secure the barrel assembly 102 into a receiver trunion located on the front face of receiver assembly 101.

Figure 3:
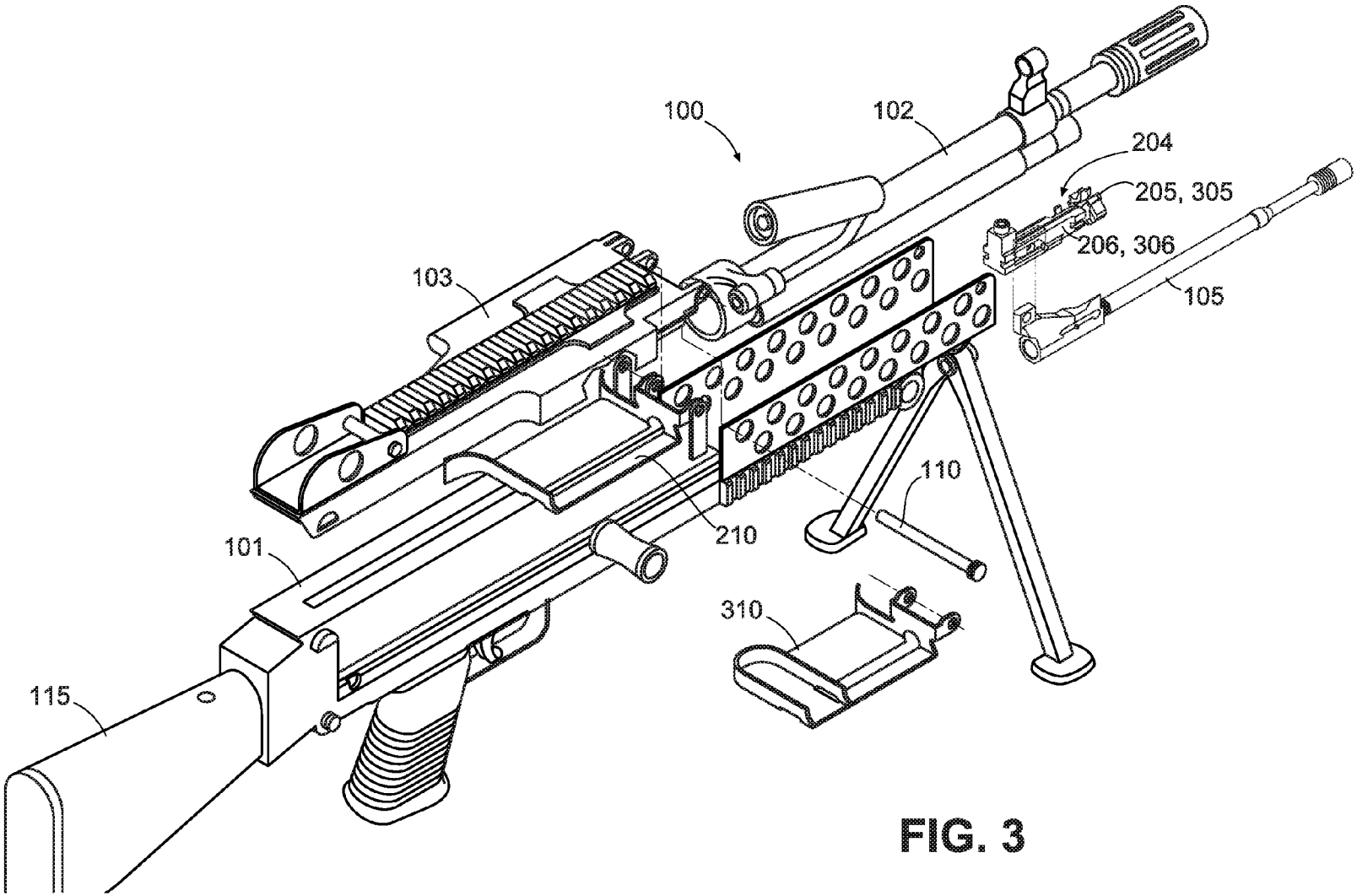
FIG. 3 is a perspective view of components of the modular multi-caliber belt-fed machine gun system of FIG. 1, showing an assembled view of the bolt carrier assembly components.

FIG. 3 is a perspective view of the modular multi-caliber belt-fed machine gun system 100, where the configuration depicted is for firing the .338 Lapua Magnum caliber round, and showing an assembled view of the bolt carrier assembly components. FIG. 3 depicts the positioning of conjoined bolt carrier assembly 204 and operating rod assembly 105 within barrel assembly 202 when the bolt carrier assembly 204, operating rod assembly 105, and barrel assembly 202, are removably attached to receiver assembly 101.

In embodiments, the modular multi-caliber belt-fed machine gun system 100 can be reconfigurable from the .338 Lapua Magnum caliber firing configuration to the 7.62 mm firing configuration, without requiring the use of tools. In particular, the gun system 100 can be configured to the 7.62 mm round firing configuration by interchanging the .338 Lapua Magnum caliber top cover 103, feed tray 210, bolt carrier assembly 204, and barrel assembly 102 with a 7.62 mm round top cover, feed tray, bolt carrier assembly and barrel assembly, respectively. To this end, the .338 caliber barrel assembly 102 can be removed from the receiver assembly 101 by disengaging the spring-loaded pin and lever and removing the barrel assembly 102 from the trunion of the receiver assembly 101. In addition, the .338 Lapua Magnum caliber feed tray 210 can be removed from the receiver assembly 101 by removing the hinge block pin 110 from the hinge block pin receptacles 111, the top cover assembly pin receptacles 212, and the .338 Lapua Magnum feed tray pin receptacles 211, allowing for the .338 Lapua Magnum caliber top cover assembly 103 to be removed, thereby allowing for the .338 Lapua Magnum feed tray 210 to be removed. Furthermore, the .338 Lapua Magnum bolt carrier assembly 204 can be removed from the receiver assembly 101 by removing rear retaining pin 206 from the rear of receiver assembly 101, separating the upper portion of the receiver assembly 101 from the lower portion of receiver assembly 101, sliding the bolt assembly 204 out of lower portion of receiver assembly 101, and disengaging the operating rod assembly 105 from .338 Lapua Magnum bolt carrier assembly 204 by removing bolt retaining pin 206.

Figure 4:
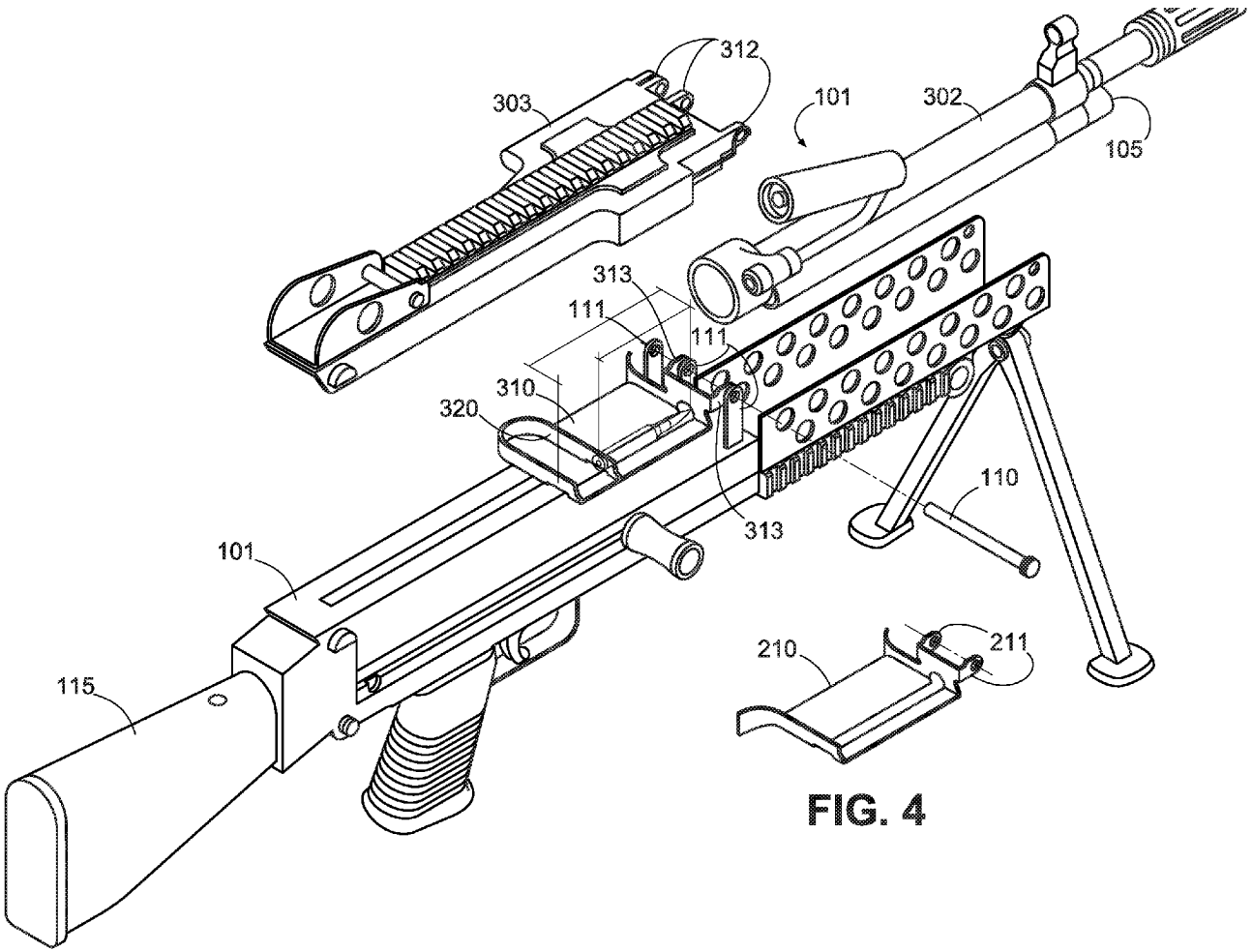
FIG. 4 is a perspective view of components of the modular multi-caliber belt-fed machine gun system of FIG. 1, where the configuration depicted is for firing a 7.62 mm round.

With reference to FIG. 4, shown is a perspective view of the modular multi-caliber belt-fed machine gun system 101 configured to fire the 7.62 mm round. When configured as shown in FIG. 4, a 7.62 mm round feed tray 310 can be removably attached to the receiver assembly 101 by the hinge block pin 110 being removably inserted into the block pin receptacles 111, top cover assembly pin receptacles 312 when the 7.62 mm round top cover assembly 303 is fitted onto the top of the receiver assembly 101 over the feed tray 310, and feed tray pin receptacles 313. The 7.62 mm round top cover 303 and feed tray 310 allow 7.62 mm rounds to be fed into the receiver assembly 101 for firing through a 7.62 mm round barrel assembly 302 by the a 7.62 mm round bolt carrier assembly (not shown) and the operating rod assembly 105 comprising a gas cylinder piston.

The 7.62 mm round bolt carrier assembly can comprise a bolt with a bolt face designed to fit a 7.62 mm round and a carrier. The 7.62 mm round bolt carrier assembly can be removably attached to the operating rod assembly 105 with the bolt retaining pin 206. The coupled 7.62 mm round bolt carrier assembly and operating rod assembly 105 can be removably inserted into the lower portion of the receiver assembly 101, and the upper and lower portions of receiver assembly 101 can be joined and secured by insertion of a rear retaining pin. A 7.62 mm round barrel assembly 302 can be removably attached to the receiver assembly 101 by a spring-loaded pin and lever securing barrel assembly into a barrel extension nozzle located on the front face of the receiver assembly 101. The aft end of the 7.62 mm round barrel assembly 302 can have the same outer diameter as the aft end of .338 Lapua Magnum caliber barrel assembly 202, so as to fit within the trunion of the receiver assembly 101 but have an inner diameter and shape configured to fire 7.62 mm rounds.

The 7.62 mm round feed tray 310 can be configured to accommodate a 7.62 mm round while have the same or approximately the same exterior width and length as the .338 Lapua Magnum feed tray 210. To this end, the 7.62 mm round can comprise a shoulder 320 that causes the rim of the 7.62 mm round to be displaced from the aft end of the 7.62 mm round feed tray 310. For example, the shoulder 320 can cause the rim of the 7.62 mm round to be displaced from about 20 mm to about 25 mm from the aft end of the 7.62 mm round feed tray 310. In some embodiments, the shoulder 320 can cause the rim of the 7.62 round to be displaced about 23.6 mm from the aft end of the 7.62 mm round feed tray 310.

Figure 5A:
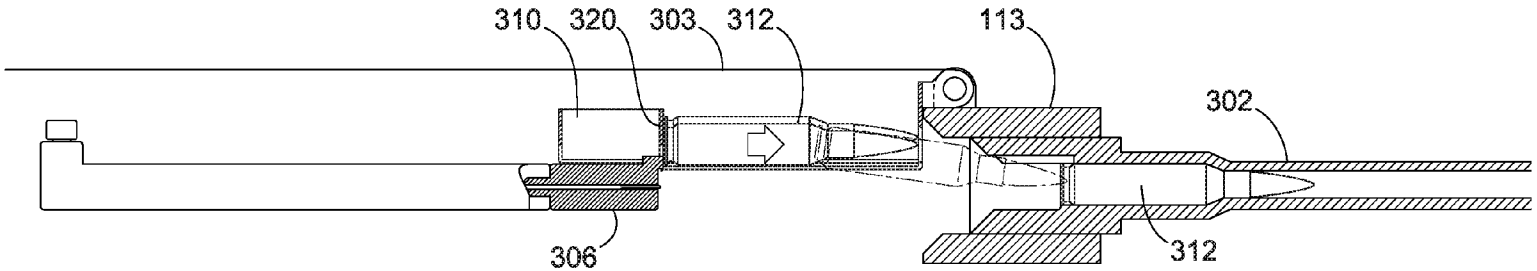
FIGS. 5A, 5B, 5C, 5D, 5E and 5F are side-perspective views of a firing cycle of the modular multi-caliber belt-fed machine gun of FIG. 1, showing the firing cycle of a 7.62 mm round.
Figure 5B:
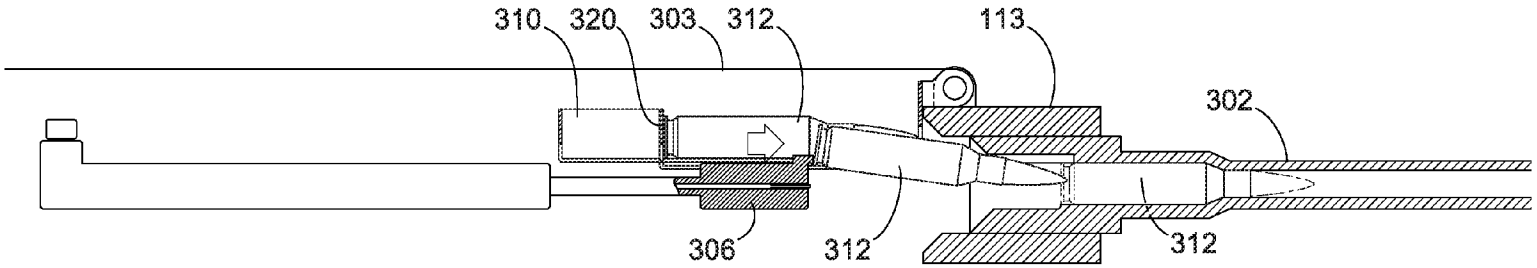
Figure 5C:
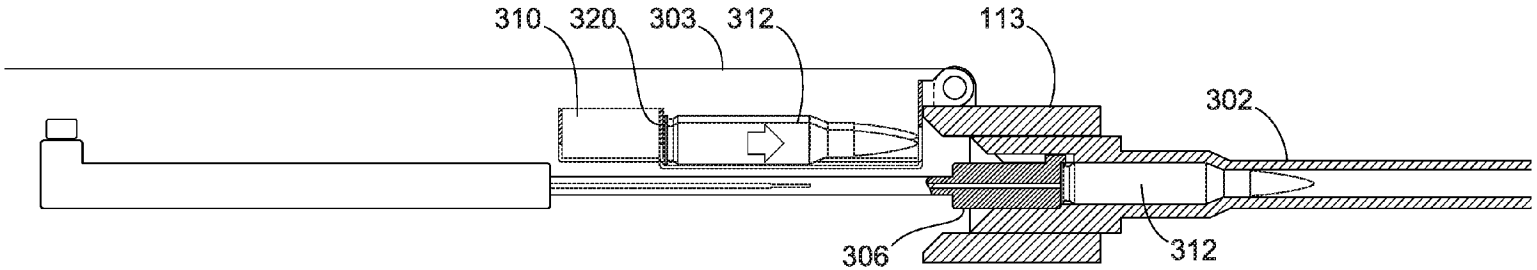
Figure 5D:
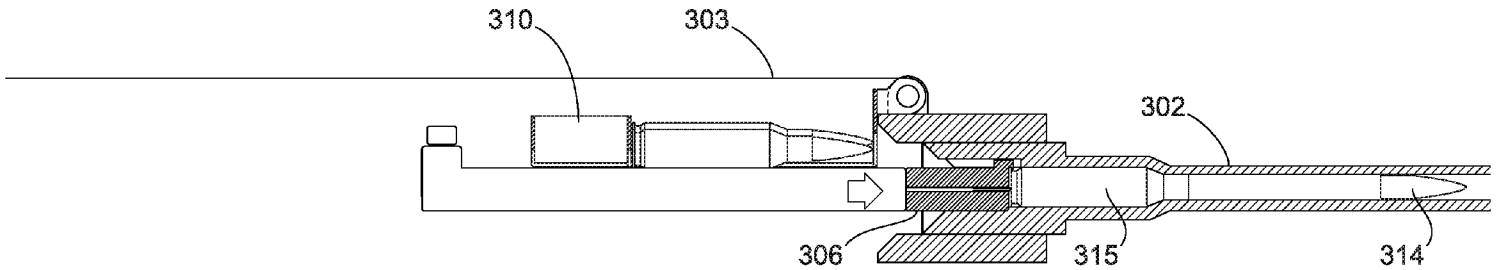
Figure 5E:
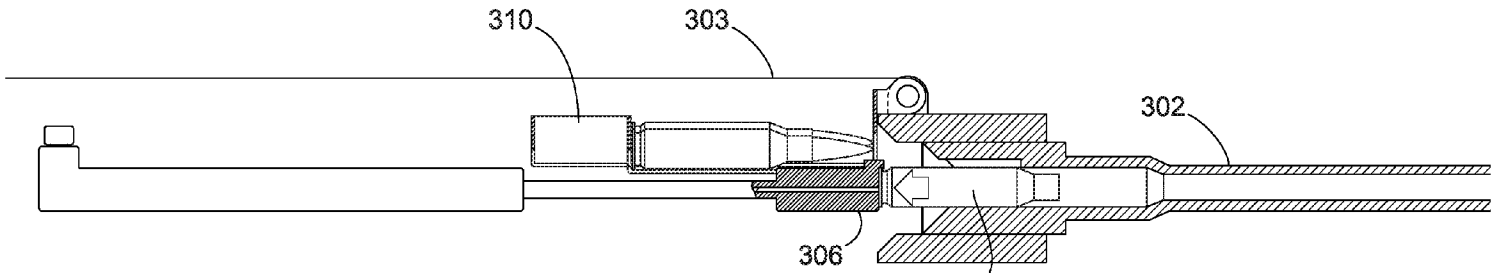
Figure 5F:
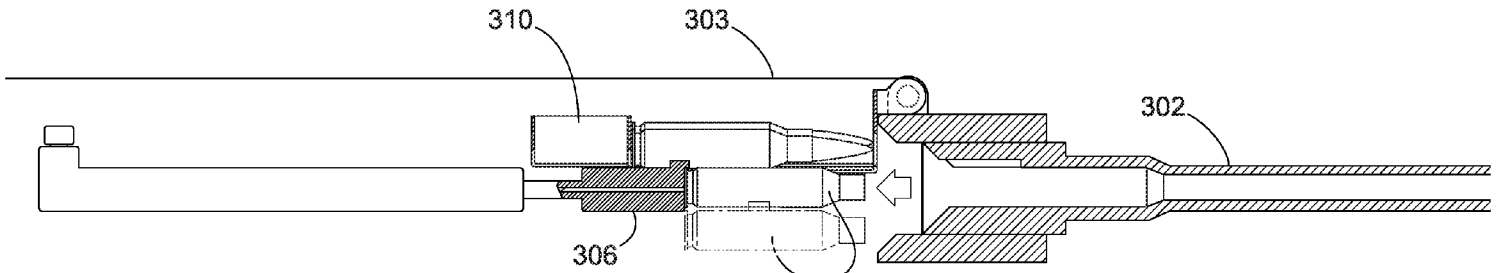

FIGS. 5A, 5B, 5C, 5D, 5E and 5F are side-perspective views of a portion of the modular multi-caliber belt-fed machine gun system 100, showing an example of a firing cycle of a 7.62 round 312 fired from the gun system 100, and detailing stripping, chambering, firing, extraction and ejection of 7.62 mm round 312. FIG. 5A depicts the stripping of a round 312 from the 7.62 mm round feed tray 310. FIG. 5B depicts the chambering of the round 312 with bolt carrier assembly retracted to allow the round 312 into the firing chamber of the 7.62 mm round barrel assembly 302. FIG. 5C depicts round 312 chambered within firing chamber 313 of 7.62 barrel assembly 302. FIG. 5D depicts the firing of the 7.62 mm round 312, where the projectile 314 is propelled away from the casing 315. FIG. 5E depicts the extraction of the 7.62 mm round casing 315 from the firing chamber. FIG. 5F depicts the ejection of the 7.62 mm round casing 315 from the receiver assembly 101.

In embodiments, the firing cycle of the modular multi-caliber belt-fed machine gun system 100 for a .338 Lapua Magnum round can be similar to the firing cycle of the 7.62 mm round that is depicted in FIGS. 5A-5F.

It is noted that amounts and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

While particular embodiments of modular multi-caliber machine gun systems and methods have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

At least the following is claimed:

1. A multi-caliber machine gun system, comprising:

a receiver assembly;

a first ammunition feed tray configured to removably attach to the receiver assembly and to feed a first type of ammunition to the receiver assembly, wherein the first type of ammunition comprises a .338 Lapua Magnum caliber round;

a second ammunition feed tray configured to removably attach to the receiver assembly and to feed a second type of ammunition to the receiver assembly, wherein the second type of ammunition comprises a 7.62 mm round; and wherein the receiver assembly is configured to fire the first type of ammunition when the first ammunition feed tray is removably attached to the receiver assembly, and wherein the receiver assembly is configured to fire the second type of ammunition when the second ammunition feed tray is removably attached to the receiver assembly.

2. The multi-caliber machine gun system of claim 1, wherein the first ammunition feed tray and the second ammunition feed tray are configured to removably attach to the receiver assembly without using a tool.

3. The multi-caliber machine gun system of claim 1, further comprising:

a first top cover for the first ammunition feed tray, wherein the first top cover is configured to be removably attached to the receiver assembly; and a second top cover for the second ammunition feed tray, wherein the second top cover is configured to be removably attach to the receiver assembly.

4. The multi-caliber machine gun system of claim 3, wherein the first ammunition feed tray and the second ammunition feed tray are configured to removably attach to the receiver assembly without using a tool.

5. The multi-caliber machine gun system of claim 1, further comprising:

a first barrel assembly configured to be removably attached to the receiver assembly to fire the first type of ammunition; and a second barrel assembly configured to be removably attached to the receiver assembly to fire the second type of ammunition.

6. The multi-caliber machine gun system of claim 5, wherein the first ammunition feed tray and the second ammunition feed tray are configured to removably attach to the receiver assembly without using a tool.

7. The multi-caliber machine gun system of claim 1, further comprising:

a first bolt carrier assembly configured to be removably installed in the receiver assembly to fire the first type of ammunition; and a second bolt carrier assembly configured to be removably installed in the receiver assembly to fire the second type of ammunition.

8. The multi-caliber machine gun system of claim 1, further comprising an operating rod assembly attached to the receiver assembly.

9. A method, comprising:

feeding a receiver assembly of a multi-caliber machine gun a first type of round using a first ammunition feed tray, wherein the first type of round comprises a .338 Lapua Magnum caliber round;

removing the first ammunition feed tray from the multi-caliber machine gun;

removably attaching a second ammunition feed tray to the multi-caliber machine gun; and feeding the receiver assembly of the multi-caliber machine gun a second type of round using the second ammunition feed tray, wherein the second type of round comprises a 7.62 mm round.

10. The method of claim 9, further comprising:

removably attaching a first top cover to the receiver assembly prior to feeding the receiver assembly the first type of round;

removing the first top cover from the receiver assembly; and removably attaching a second top cover to the receiver assembly prior to feeding the receiver assembly the second type of round.

11. The method of claim 9, further comprising:

removably attaching a first barrel assembly to the receiver assembly prior to feeding the receiver assembly the first type of round;

removing the first barrel assembly from the receiver assembly; and removably attaching a second barrel assembly to the receiver assembly prior to feeding the receiver assembly the second type of round.

12. The method of claim 9, further comprising:

removably installing a first bolt carrier assembly in the receiver assembly prior to feeding the receiver assembly the first type of round;

removing the first bolt carrier assembly; and removably installing a second bolt carrier assembly in the receiver assembly prior to feeding the receiver assembly the second type of round.

13. The method of claim 9, wherein removing the first ammunition feed tray from the multi-caliber machine gun and removably attaching the second ammunition feed tray to the multi-caliber machine gun is performed without using a tool.

14. A multi-caliber machine gun system, comprising:

a receiver assembly;

a first ammunition feed tray removably attached to the receiver assembly, wherein the first ammunition feed tray is configured to feed a first type of ammunition to the receiver assembly, wherein the first type of ammunition comprises a .338 Lapua Magnum caliber round; and wherein the receiver assembly is configured to be removably attached to a second ammunition feed tray when the first ammunition feed tray is removed from the receiver assembly, wherein the second ammunition feed tray is configured to feed a second type of ammunition to the receiver assembly, wherein the second type of ammunition comprises a 7.62 mm round.

15. The multi-caliber machine gun system of claim 14, wherein the first ammunition feed tray and the second ammunition feed tray have the same exterior width.

16. The multi-caliber machine gun system of claim 14, wherein the first ammunition feed tray and the second ammunition feed tray have the same exterior length.

17. The multi-caliber machine gun system of claim 14, wherein the first ammunition feed tray comprises a shoulder configured to position a rim of a round to be displaced from an aft end of the first ammunition feed tray.

18. A gun system, comprising:

a receiver assembly;

a first ammunition feed tray configured to removably attach to the receiver assembly and to feed a first type of ammunition to the receiver assembly, wherein the first type of ammunition comprises a .338 Lapua Magnum caliber round;

a second ammunition feed tray configured to removably attach to the receiver assembly and to feed a second type of ammunition to the receiver assembly, wherein the second type of ammunition comprises a 7.62 mm round; and wherein the receiver assembly is configured to fire the first type of ammunition when the first ammunition feed tray is removably attached to the receiver assembly, and wherein the receiver assembly is configured to fire the second type of ammunition when the second ammunition feed tray is removably attached to the receiver assembly.

19. The gun system of claim 18, wherein the first ammunition feed tray and the second ammunition feed tray are configured to removably attach to the receiver assembly without using a tool.

20. The gun system of claim 18, further comprising:

a first top cover for the first feed tray, wherein the first top cover is configured to be removably attached to the receiver assembly; and a second top cover for the second feed tray, wherein the second top cover is configured to be removably attach to the receiver assembly.

21. The gun system of claim 18, further comprising:

a first bolt carrier assembly configured to be removably installed in the receiver assembly to fire the first type of ammunition; and a second bolt carrier assembly configured to be removably installed in the receiver assembly to fire the second type of ammunition.

22. The gun system of claim 18, further comprising an operating rod assembly attached to the receiver assembly.

* * * * *